US009644841B2

(12) United States Patent
Zogg

(10) Patent No.: US 9,644,841 B2
(45) Date of Patent: May 9, 2017

(54) CHIMNEY DUCT

(75) Inventor: Brad Zogg, Blue Grass, IA (US)

(73) Assignee: The Schebler Co., Bettendorf, IA (US)

( * ) Notice: Subject to any disclaimer, the term of this patent is extended or adjusted under 35 U.S.C. 154(b) by 1101 days.

(21) Appl. No.: 12/359,163

(22) Filed: Jan. 23, 2009

(65) Prior Publication Data

US 2009/0191802 A1 Jul. 30, 2009

Related U.S. Application Data

(60) Provisional application No. 61/062,383, filed on Jan. 25, 2008.

(51) Int. Cl.
*F16L 23/00* (2006.01)
*F23J 13/02* (2006.01)

(52) U.S. Cl.
CPC ..... *F23J 13/02* (2013.01); *F23J 2213/202* (2013.01); *Y10T 29/53* (2015.01)

(58) Field of Classification Search
CPC ..... F16L 23/00; Y10T 29/49908; Y10T 29/49968; B21D 39/02; B21D 51/06; B21D 51/52
USPC ..... 454/3, 47; 285/47; 29/890.145, 557, 29/469.5, 525.14; 72/368
See application file for complete search history.

(56) References Cited

U.S. PATENT DOCUMENTS 390,438 A * 10/1888 Bradbeer ..... 285/123.16
490,579 A * 1/1893 Miller ..... 285/123.16
499,854 A * 6/1893 Schaffer ..... 285/123.16
525,467 A * 9/1894 McMillin ..... 285/123.16
583,819 A * 6/1897 Rome ..... 285/123.16
629,095 A * 7/1899 Stearns ..... 285/123.16
696,059 A * 3/1902 Line ..... 285/55
724,210 A * 3/1903 Scherer ..... 285/123.16
1,593,256 A * 7/1926 Harms ..... 285/123.16
1,652,827 A * 12/1927 Holub ..... 285/123.16
1,890,930 A * 12/1932 Blackmore ..... 126/307 R
2,588,496 A * 3/1952 Dollinger ..... 454/47
2,910,311 A * 10/1959 Carr ..... 285/123.16
2,963,783 A * 12/1960 Field ..... 428/581
3,016,227 A * 1/1962 Lawrence et al. ..... 415/201
3,631,789 A * 1/1972 Kinsey ..... 454/47
3,872,780 A * 3/1975 Zanias ..... 454/47
3,902,744 A 9/1975 Stone
(Continued)

*Primary Examiner* — Steven B McAllister
*Assistant Examiner* — Samantha Miller
(74) *Attorney, Agent, or Firm* — Hamilton IP Law, PC; Jay R. Hamilton; Charles A. Damschen

(57) ABSTRACT

A chimney section and a chimney system for handling gases is disclosed. The chimney section is rounded but non-circular in cross sectional shape and includes at least one flange on one end of the section body. The chimney section may be formed from a single piece of material, wherein the section body and flange are integrally formed with one another. In the chimney system, the junction between two adjacent chimney sections may consist of a flange interface, which is formed by the adjacent flanges on opposing ends of two adjacent chimney sections. A V-band may be placed over the flange interface to further seal the interior of the chimney sections, and a sealant may be placed in various positions of the chimney system to hermetically seal the interior thereof from the exterior. In another embodiment of the chimney system, insulation is added to create an insulated chimney system.

19 Claims, 6 Drawing Sheets

(56) References Cited

U.S. PATENT DOCUMENTS

| | | | | |
|---|---|---|---|---|
| 4,029,344 | A | 6/1977 | Stone | |
| 4,160,559 | A | 7/1979 | Nickels, Jr. | |
| 4,182,378 | A | 1/1980 | Dieter | |
| 4,724,750 | A * | 2/1988 | Coleman et al. | 454/47 |
| 4,929,000 | A * | 5/1990 | Annestedt, Sr. | 285/123.16 |
| 5,129,690 | A * | 7/1992 | Meinig et al. | 285/363 |
| 5,135,270 | A * | 8/1992 | Arnoldt et al. | 285/363 |
| 5,878,786 | A * | 3/1999 | Elder | 138/163 |
| 6,109,665 | A * | 8/2000 | Meinig | 285/405 |
| 6,505,864 | B1 * | 1/2003 | Shuey | 285/364 |
| 7,216,898 | B1 * | 5/2007 | Hermanson | 285/405 |
| 7,712,787 | B2 * | 5/2010 | Vincenti | 285/47 |
| 2002/0067950 | A1 * | 6/2002 | Price et al. | 403/338 |
| 2002/0094233 | A1 * | 7/2002 | Price et al. | 403/338 |
| 2002/0124614 | A1 * | 9/2002 | Hermanson | 72/82 |
| 2002/0139160 | A1 * | 10/2002 | Price et al. | 72/49 |
| 2002/0140151 | A1 * | 10/2002 | Couturier | 270/58.07 |
| 2003/0006611 | A1 * | 1/2003 | Shuey | 285/364 |
| 2007/0257487 | A1 | 11/2007 | Jacklich et al. | |

* cited by examiner

CHIMNEY DUCT

CROSS REFERENCE TO RELATED APPLICATIONS

Applicant claims priority under 35 U.S.C. §119(e) of provisional U.S. Patent App. No. 61/062,383 filed on Jan. 25, 2008, which is incorporated by reference herein in its entirety.

FIELD OF INVENTION

The present invention relates to duct work for handling various types of gases. More particularly, the present invention is especially useful in providing an air-tight connection between two rounded but non-circular duct sections.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND

Double-walled chimneys are known in the art, one example of which is disclosed in the U.S. Pat. No. 3,902,744 to Stone and prior art cited therein. The basic construction involves inner and outer concentric pipes affording an annular insulating space between them. Fundamentally, the assembly or erection of the chimney proceeds with coaxial, end-to-end stacking of, say, a pair of inner pipes, the meeting ends of which are radially outwardly flanged to receive an inner annular ring which clamps the pipes together.

Another example of a double-walled chimney is disclosed in U.S. Pat. No. 4,724,750, which is incorporated by reference herein. These and other prior art references show that it is known in the art to fabricate corresponding flanges on two adjacent sections at the interface thereof. The flanges are typically transverse to the basic axis of the chimney section. Typically an annular ring is placed over the junction of the two corresponding flanges to better seal the chimney.

Although these flanged chimney sections are well known when the cross-sectional shape of the chimney is circular or angular (such as rectangular, square, etc.), the prior art does not disclose a flanged chimney section or corresponding connection system for chimneys with a cross-sectional area that is rounded but non-circular. One such rounded but non-circular shape is often referred to as "obround." As used herein, "obround" is defined as a shape consisting of two semicircles connected by parallel lines tangent to their endpoints.

SUMMARY OF THE INVENTION

A chimney system is disclosed that allows flanged connections oriented perpendicularly from the main axis of the chimney between adjacent sections with the sections have a rounded, non-circular cross-sectional shape, such as elliptical or obround. The dimensions of the flange on each section will vary depending on the specific application of the chimney system. To connect two adjacent sections, a V-band may be placed over the flange interface. The V-band may increase the sealing ability of the chimney system at the flange interface. A sealant may be applied at the flange interface to further increase the sealing ability of the chimney system. The chimney system may be used with an outer shell, wherein insulation is positioned between the inner shell and the outer shell. Such a configuration creates a dual-wall, insulated chimney system. Other configurations with additional walls exist, but are not pictured herein, such as a tri-wall insulated chimney system.

The chimney as disclosed herein may be used in venting exhaust gases having a negative, neutral, or positive draft system. The chimney is ideal for use in venting the exhaust of hot water heaters, boilers, and diesel generators. It may be produced in variable lengths for ease of handling and use.

The present art has several advantages over the prior art including reduced outer shell temperatures, and consequently reduced mechanical room temperatures. The connection system of the present art allows reduced clearances, thereby allowing a chimney section to be placed closer to the building materials, saving space in mechanical rooms and in chaises.

Accordingly, it is one object of the present invention to provide a flanged sealing mechanism for two adjacent chimney sections, wherein the cross-sectional area of the chimney sections is rounded but non-circular, such as obround. This reduces installation costs since the flanges need not be separately fabricated and affixed to the section body of each section.

Other objects of the present invention will become apparent to those skilled in the art in light of the present disclosure.

BRIEF DESCRIPTION OF THE FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION—LISTING OF ELEMENTS

Figure 1:
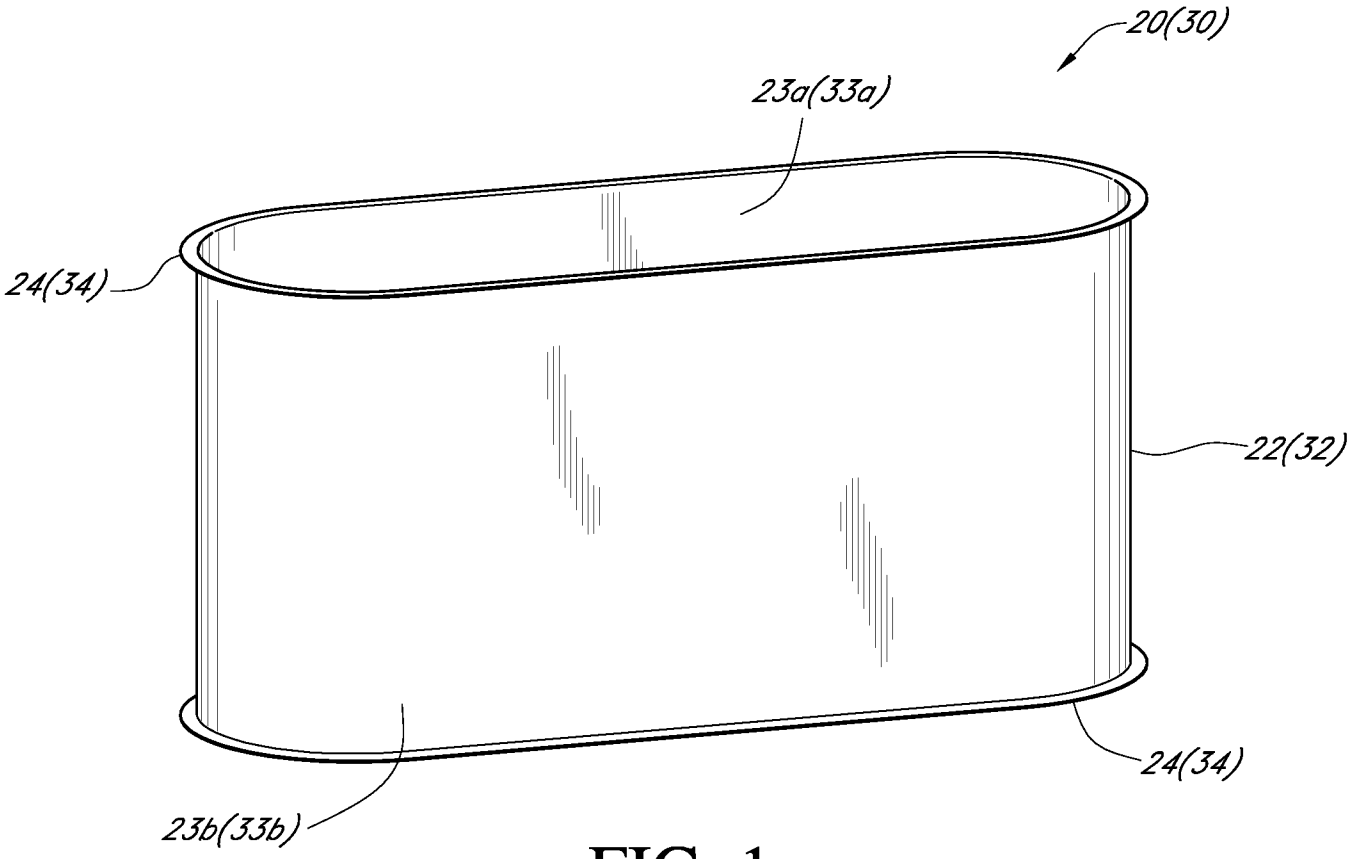
FIG. 1 is a perspective view of one chimney section of a first embodiment.

| ELEMENT DESCRIPTION | ELEMENT # |
|---|---|
| Chimney system | 10 |
| First section | 20 |
| First section body | 22 |
| First section body interior | 23a |
| First section body exterior | 23b |
| First section flange | 24 |
| Second section | 30 |
| Second section body | 32 |
| Second section body interior | 33a |
| Second section body exterior | 33b |
| Second section flange | 34 |
| Flange interface | 36 |
| V-band | 40 |
| First flat portion | 42a |
| Second flat portion | 42b |
| First angled portion | 44a |
| Second angled portion | 44b |
| V-band apex | 46 |
| V-band clamp | 48 |
| Insulated chimney system | 50 |
| Insulated chimney section | 51 |
| Insulation | 52 |
| Spacer clip | 53 |
| Spacer clip inner tab | 53a |
| Spacer clip outer tab | 53b |
| Inner shell | 55 |
| Inner shell flange | 55a |
| Outer shell | 56 |
| Outer shell channel | 56a |
| Outer band | 57 |
| Sheet | 60 |
| Sheet right edge | 61a |
| Sheet left edge | 61b |
| Crease | 62 |
| Outer section | 64 |
| Inner section | 66 |
| Middle section | 68 |

DETAILED DESCRIPTION

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", back "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

Referring now to the drawings, wherein like reference numerals designate identical or corresponding parts throughout the several views, FIG. 1 illustrates a first embodiment of a first section 20 of the chimney system 10. The chimney system 10 as disclosed herein may comprise any number of sections 20, 30, but for clarity only two sections 20, 30 (a first section 20 and a second section 30) are discussed and pictured herein.

Figure 4:
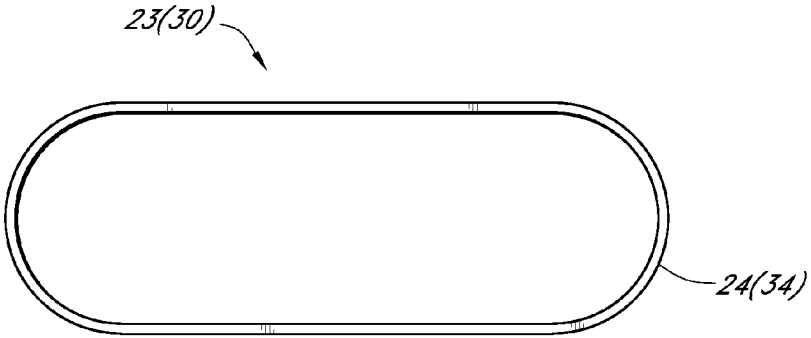
FIG. 4 is an end view of a chimney section of the first embodiment wherein the cross-sectional shape of the chimney section is obround.

The sections 20, 30 of the first embodiment are obround in shape, which is best shown in FIGS. 1 and 4, the latter of which is an end view of a section 20, 30. Each section 20, 30 includes a section body 22, 32. The inner surface of the first section body 22 is comprised of a first section body interior 23*a*, and the exterior surface is comprised of a first section body exterior 23*b*. Correspondingly, the inner surface of the second section body 32 is comprised of a second section body interior 33*a*, and the exterior surface is comprised of a second section body exterior 33*b*. Generally, the fluid routed through the chimney system 10 passes through the portion of space bounded by the section body interiors 23*a*, 33*a*.

The first section 20, as best shown in FIG. 1 may include a first section flange 24 on each end of the first section body 22. Each first section flange 24 is generally perpendicular to the main longitudinal axis of the first section body 22. Each first section flange 24 is integrally formed with the first section body 22. In this manner, the entire first section 20 may be formed from one piece of material. The specific dimensions of the first section flange 24 and the orientation thereof with respect to the first section body 22 will vary depending on the specific application for the chimney system 10. In some applications, it is envisioned that the first section flange 24 will be oriented exactly ninety degrees from the first section body exterior 23*b*, such that the first section body 22 and the first section flange 24 form a right angle between them, and that the first section flange 24 extend one-half inch from the first section body exterior 23*b*. The precise angle between the first section flange 24 and first section body exterior 23*b* will be greater or less than ninety degrees in other embodiments not pictured herein without departing from the spirit and scope of the chimney system 10 as claimed. Furthermore, the first section flange 24 may extend from the first section body exterior 23*b* by an amount greater or less than one-half inch, and is therefore in no way limiting in scope.

Figure 2:
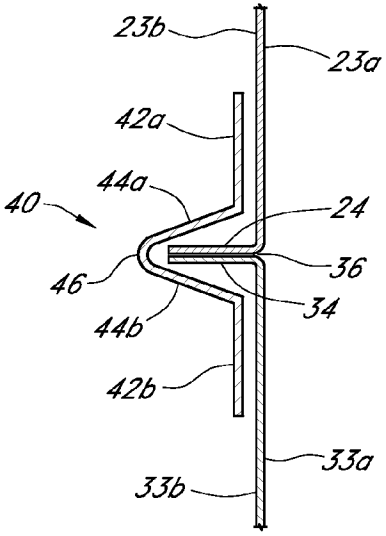
FIG. 2 is a detailed, cross-sectional view of the junction of two adjacent chimney sections according to the first embodiment.

One embodiment of the junction between the first section 20 and the second section 30 is shown in detail in FIG. 2. The cross-sectional view of this junction as shown in FIG. 2 clearly shows the first section flange 24 abutted with the second section flange 34 to form a flange interface 36. Although not shown in FIG. 2, a sealant (not shown) may be placed at the flange interface 36. In the first embodiment, first section flange 24 is perpendicular to the first section body 22 and the second section flange 34 is perpendicular to the second section body 32. Furthermore, the first section body 22 is parallel to the second section body 32, and the first section flange 24 is parallel to the second section flange 34. Because the first and second section flanges 24, 34 are parallel to one another, the flange interface 36 includes nearly the entire surface area of both the first and second section flanges 24, 34. In many applications this configuration allows for a better seal at the flange interface 36.

In the first embodiment, a V-band 40 is placed over the flange interface 36. The V-band 40, as shown in FIG. 2, includes a first flat portion 42*a* that abuts the first section body exterior 23*b* and a corresponding second flat portion 42*b* that abuts the second section body exterior 33*b*. To ensure the clearance between the respective flat portions 42*a*, 42*b* and section body exteriors 23*b*, 33*b* is optimal, the V-band 40 includes a V-band clamp 48 for adjusting the tension of the V-band clamp 48. As shown herein, the V-band clamp 48 is a typical bolt and receiver clamp with two bolts, and which will not be described further herein for purposes of clarity. However, the V-band clamp 48 may be of any type known to those skilled in the art for adjusting the tension of banding structures around the exterior of a section 20, 30 without departing from the scope of the present invention. The first flat portion 42*a* is connected to the first angled portion 44*a* and the second flat portion 42*b* is connected to the second angled portion 44*b*. The first angled portion 44*a* and the second angled portion 44*b* are connected by the V-band apex 46. The relative angles and orientations between and among the first flat portion 42*a*, second flat portion 42*b*, first angled portion 44*a*, second angled portion 44*b*, and V-band apex 46 may be different than those show here in other embodiments without departing from the spirit and scope of the present invention.

Figure 3:
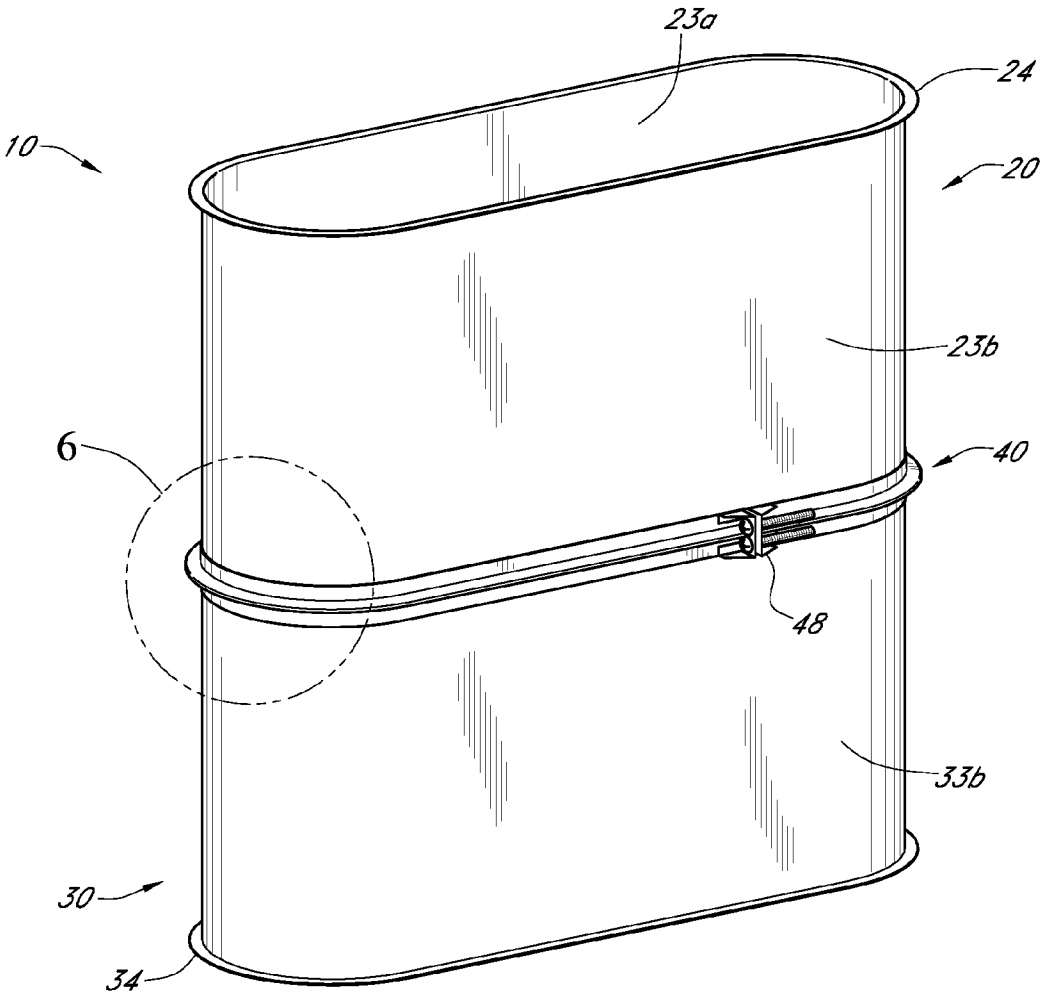
FIG. 3 is a perspective view of two chimney sections of the first embodiment joined to one another with a V-band.
Figure 6:
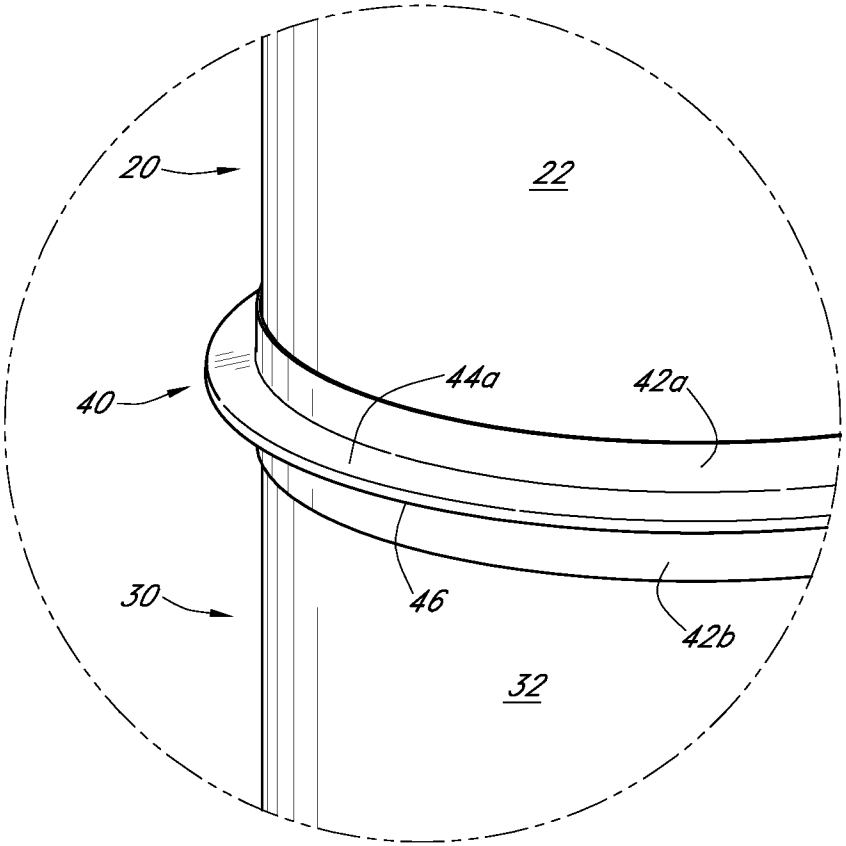
FIG. 6 is a detailed view of the exterior of the chimney at the junction of two sections with a V-band applied thereto.

Although not shown in FIG. 2, sealant (not shown) may be positioned between the flange interface 36 and any portion of the V-band 40, and/or between the first section body exterior 23*b*, second section body exterior 33*b* and the first flat portion 42*a* or second flat portion 42*b*. The sealant (not shown) placed in any of the areas listed above may be used to hermetically seal the flange interface 36 and/or the junction of the first and second sections 20, 30. The sealant (not shown) used in any embodiments of either the chimney system 10 or insulated chimney system 50 (described in detail below) may be any type of sealant (not shown) known to those skilled in the art that is appropriate for the particular application, whether silicon-based, teflon based, or otherwise. For example, S600 or S2000 may be used as a sealant (not shown) to enhance the gas impermeable seal, which may be rated or used with a range of pressures including negative, neutral, or positive pressures greater than one atmosphere (1 ATM). As those of ordinary skill in the art will appreciate, although not shown in the various figures herein, the chimney system 10 and insulated chimney system 50 also may have an insulating material positioned between the V-band 40 and flange interface 36. The first embodiment of the junction between the first section 20 and second section 30 is shown in perspective in FIG. 3, and FIG. 6 shows the junction of the first and second section 20, 30 with the V-band 40 applied thereto in greater detail.

Figure 5:
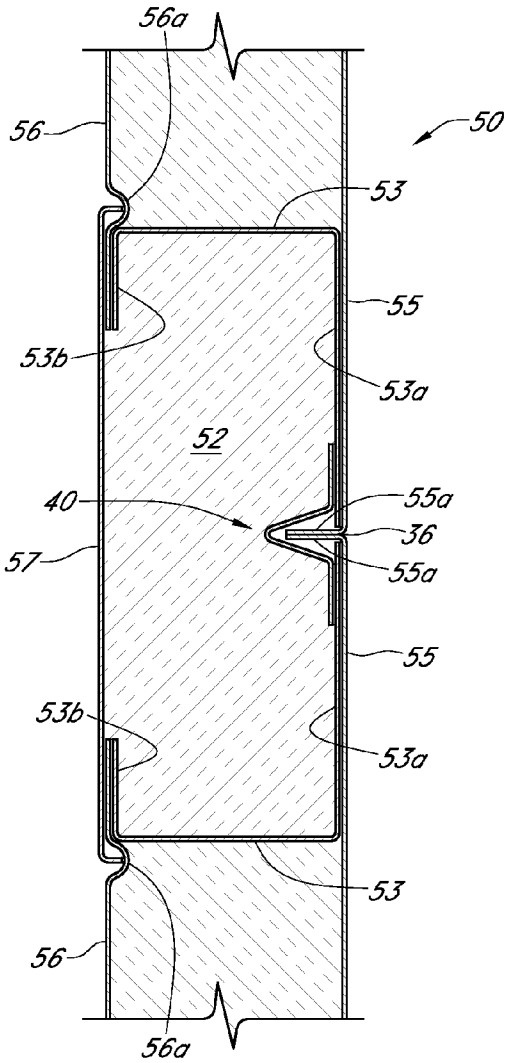
FIG. 5 is a detailed, cross-sectional view of the junction of two adjacent chimney sections according to the second embodiment, wherein the chimney system is insulated.
Figure 7:
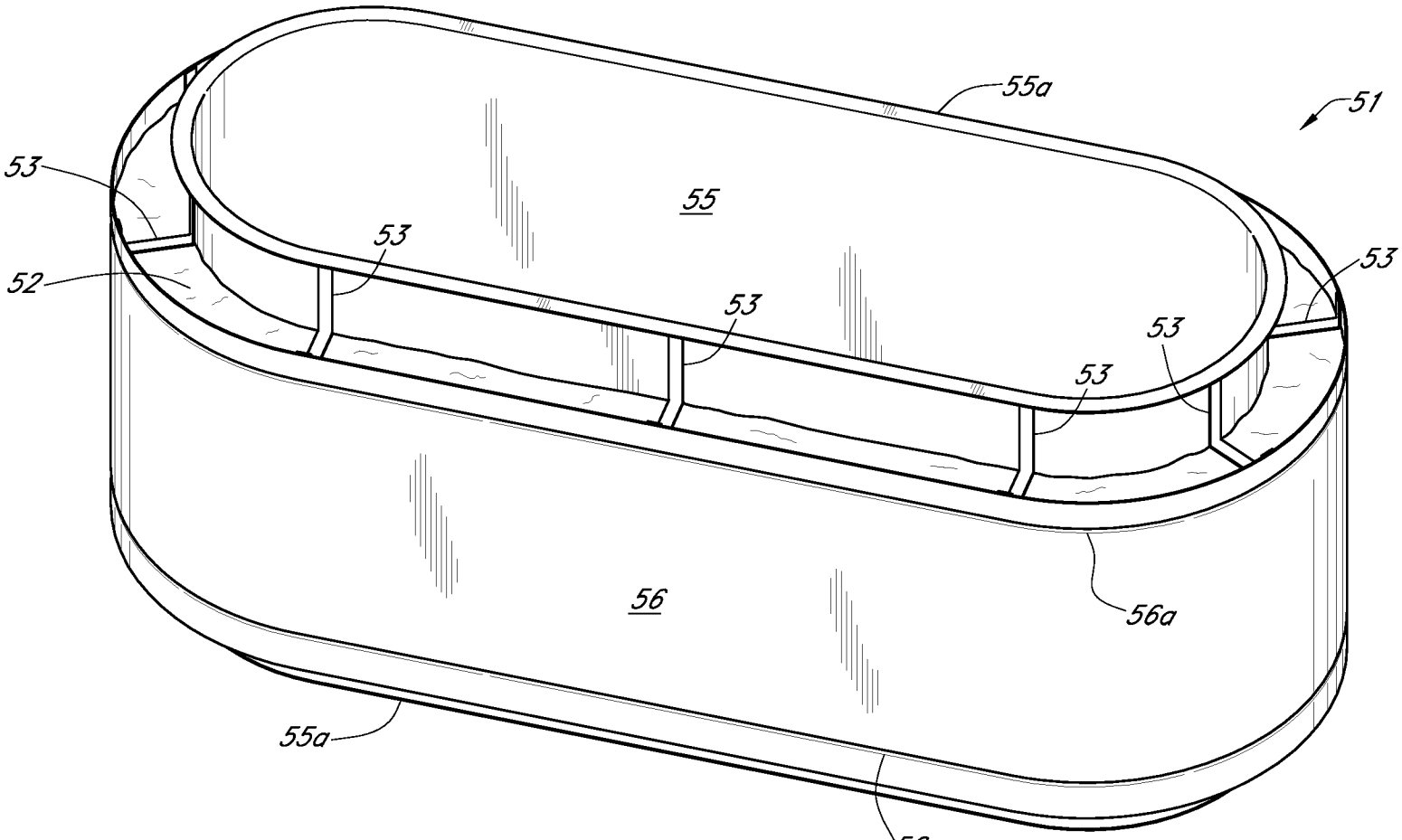
FIG. 7 is a perspective view of one chimney section of the section embodiment.

A second embodiment of the chimney system 10 is shown FIG. 5. In the second embodiment, one variation of an insulated chimney system 50 is shown, and FIG. 7 shows an insulated chimney section 51 that may be used with the insulated chimney system 50. The insulated chimney system 50 includes a plurality of insulated chimney sections 51, one embodiment of which is shown in FIG. 7. The inner shell 55 is substantially the same as the sections 20, 30 of the chimney system 10 described in detail above. Accordingly, the flange interface 36 between the two adjacent inner shells 55 of the insulated chimney system 50 shown in FIG. 5 is substantially the same as the flange interface 36 between the first section 20 and the second section 30 shown in FIG. 1.

In the insulated chimney system 50 each inner shell 55 and an outer shell 56 are substantially the same shape for a given insulated chimney section 51, although the periphery of the outer shell 56 is greater than that of the inner shell 55. As previously mentioned, each inner shell 55 of the insulated chimney system 50 is substantially the same as each section 20, 30 of the chimney system 10 described in detail above in that an inner shell flange 55a is integrally formed with the inner shell 55 on at least one end of each inner shell 55. Accordingly, the junction between two adjacent insulated chimney sections 51 at their respective inner shells 55 forms a flange interface 36 substantially similar in structure and function to that described in detail above for the chimney system 10. As described for the flange interface 36 in the chimney system 10, a V-band 40 may be used to secure one inner shell 55 to an adjacent inner shell 55.

In the insulated chimney system 50, a predetermined amount of insulation 52 is positioned between the inner shell 55 and the outer shell 56. The distance between the inner shell 55 and outer shell 56 is determined by the length of the spacer clips 53 that extend from the inner shell 55 to the outer shell 56. The spacer clips 53 and insulation 52 may be configured so that an air gap (not shown) remains between the insulation 52 and the outer shell 56 if desired. In the second embodiment, each spacer clip 53 includes a spacer clip inner tab 53*a* and spacer clip outer tab 53*b*. The spacer clip inner tab 53*a* may be placed between one of the flat portions 42*a*, 42*b* of the V-band 40, as shown in FIG. 5, or over one of the flat portions 42*a*, 42*b*. Each spacer clip outer tab 53*b* may be directly secured to the outer shell 55.

In the exemplary embodiment shown in FIG. 7, the outer shell 56 is formed with an outer shell channel 56*a* therein on at least one end of the outer shell 56. An outer band 57 may be placed between two adjacent outer shells 55. As shown in FIG. 5, the outer band 57 may be configured so that each end of the outer band 57 seats within the outer shell channel 56*a* in two adjacent outer shells 56, respectively.

To facilitate access to the inner shells 55 during assembly or for maintenance, adjacent outer shells 56 may be formed with a significant space therebetween, as shown in FIG. 5. As described above, an outer band 57 may be placed between two adjacent outer shells 55 to seal the space between the two outer shells 55. The amount of space between adjacent outer shells 55 (and consequently the dimensions of the outer band 57) will vary depending on the specific application of the insulated chimney system 50, and is therefore in no way limiting. The inner and outer shells 55, 56 may be connected together with the spacer clips 53 prior to installation of the insulated chimney system 50, and insulation 52 may be placed between the inner and outer shells 55, 56, allowing corresponding inner and outer shells 55, 56 to be installed as one unit, referred to herein as an insulated chimney section 51. As is apparent to those skilled in the art in light of the present disclosure, both the chimney system 10 and the insulated chimney system 50 of the present invention allow for tension to be applied to either the V-band 40 and/or the outer band 57 in a direction perpendicular to the longitudinal axis of the chimney system 10 or insulated chimney system 50.

In one embodiment of the chimney system 10 the first section 20 and second section 30 are both comprised of twenty gauge 304 stainless steel. In one embodiment of the insulated chimney system 50 the inner shell 55 is comprised of twenty gauge 304 stainless steel. An insulation layer is typically applied. The longitudinal seams for any section 20, 30 of the chimney system 10, or any inner shell 55 or outer shell 56 of the insulated chimney system 50 may be continuously welded to reduce corrosion and ensure a pressure tight seal at each seam. Those of ordinary skill in the art will appreciate that other means and methods of manufacture are possible, without limitation.

The sections 20, 30, V-band 40, V-band clamp 48, spacer clip 53, inner shell 55, and outer shell may be made from twenty gauge 304 stainless steel, higher or lower chrome steels, or any other material known to those skilled in the art that is suitable for the application. However, the material chosen in no way limits the scope of the present invention, and such specifications are limited only by the particular application for which the chimney system 10 or insulated chimney system 50 is used.

As shown in the end view of a section 20, 30 shown in FIG.4, the cross-sectional shape of each section 20, 30 in the first embodiment is obround. However, the chimney system 10 or insulated chimney system 50 may be configured with sections 20, 30 having cross-sectional shapes of infinite variety as long as the cross-sectional shape is rounded but non-circular. Accordingly, the shape chosen in no way limits the scope of the present invention, and such specifications are limited only by the particular application for which the chimney system 10 or insulated chimney system 50 is used.

To better understand the present invention, one method of manufacture for the first embodiment of the section 20, 30 as pictured herein will now be described in detail. Those skilled in the art will appreciate that an infinite number of ways to manufacture a section 20, 30 for the chimney system 10 exist, and the specific method used in no way limits the scope of the chimney system 10, sections 20, 30, insulated chimney system 50, or insulated chimney sections 51. Accordingly, the method that follows is but one way to practice the present invention.

Figure 8:
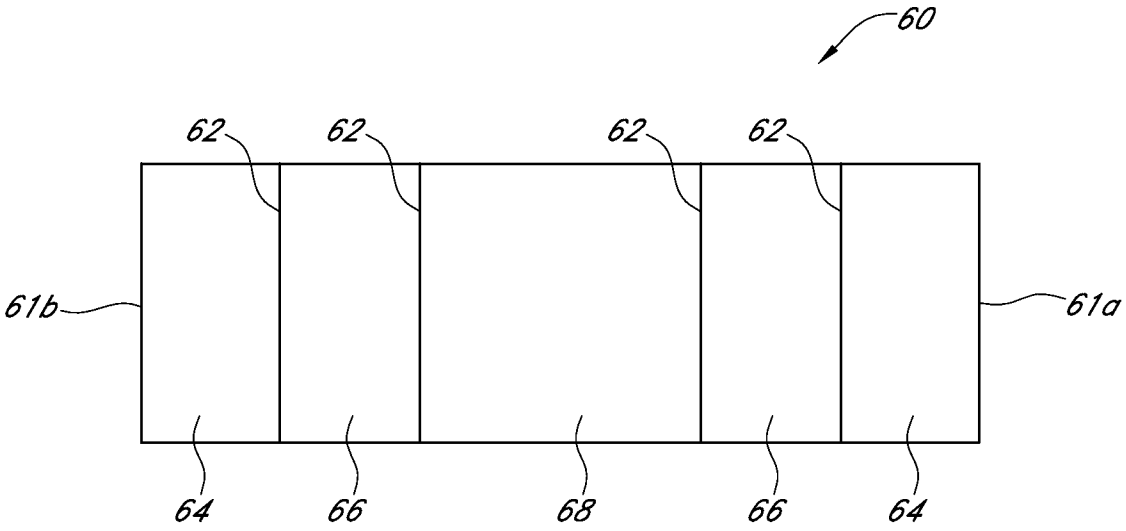
FIG. 8 is an elevated view of a sheet of material showing the creases for one embodiment of a chimney section.

A piece of material, such as stainless steel, is first cut to the dimensions required to form a sheet 60, which is shown in FIG. 8. Typically the sheet 60 is rectangular in shape, but it may be other shapes as well. The precise dimensions of the sheet 60 will be dependent on the design specifications for the chimney system 10 or insulated chimney system 50. The sheet 60 is positioned in a metal brake (not shown) and four creases 62 are formed therein. The four creases 62 serve to divide the sheet into five sections. The five sections include two outer sections 64, two inner sections 66, and one middle section 68. One outer section 64 is adjacent the sheet right edge 61*a* and the other outer section 64 is adjacent the sheet left edge 61*b*. The middle section 68 is in the geometric center of the sheet 60, and an inner section 66 is positioned on either side thereof. The two outer sections 64 are identical with one another in size and shape, and the two inner sections 66 are identical with one another in size and shape. Accordingly, the creases 62 are symmetrical about both axes of the sheet.

The sheet 60 is then placed on a metal forming roll (not shown). Each outer section 64 is then formed into a quarter-circle shape. Next, the middle section 68 is formed into a half-circle shape. After this step, the sheet right edge 61*a* and sheet left edge 61*b* are in close proximity to one another so that they may be welded together. The resulting seam runs in an axial direction along the entire length of the section 20, 30. In the first embodiment, the two outer sections 64 cooperate to form one rounded side of the section 20, 30 and the middle section 68 forms the other rounded side. The two inner sections 66 comprises the straight sides of the section 20, 30.

A rigid jig may then be placed around the outer periphery of the section 20, 30 so that the cross-sectional shape of the section 20, 30 is maintained throughout the remainder of the fabrication process. The section 20, 30 is positioned on a roll forming machine (not shown) set to form a flange 24, 34 of the desired dimensions at one end of the section 20, 30. If a second flange 24, 34 is desired on the other end of the section 20, 30, the jig is transferred closer to that end and a flange 24, 34 is formed thereon using the roll forming machine (not shown). To ensure that the section 20, 30 remains symmetrical along the longitudinal axis thereof throughout the fabrication process, the rotation of the roll forming machine (not shown) is reversed during the formation of the second flange 24, 34. That is, if the first flange 24, 34 is formed by rotating the section 20, 30 clockwise in the roll forming machine (not shown), the second flange 24, 34 is formed by rotating the section 20, 30 counter-clockwise in the roll forming machine (not shown).

The outer shell 56 for an insulated chimney section 51 may be fabricated in substantially the same manner. However, instead of forming a flange 24, 34 on the roll forming machine (not shown), a different die is used that forms an outer shell channel 56a. As with the fabrication of the section 20, 30, if the outer shell 56*a* is fabricated with an outer shell channel 56*a* on each end thereof, the direction of rotation of the outer shell 56 during formation of the first outer shell channel 56*a* should be opposite of the direction of rotation of the outer shell 56 during formation of the second outer shell channel 56*a*.

Sections 20, 30 (i.e., inner shells 55 when used in an insulated chimney system 50) may be joined with corresponding outer shells 56 through the use of spacer clips 53, many methods of which are well known to those skilled in the art and will therefore not be described in further detail herein. Insulation 52 may also be placed between the inner shell 55 and outer shell 56 so that each insulated chimney section 50 is ready to install before it is exposed to the elements.

It is contemplated that other machines other than those described for use in the above method may be used to fabricate sections 20, 30, inner shells 55, outer shells 56, or insulated chimney sections 51. Accordingly, the specific machine used to fabricate any element of the chimney system 10 or insulated chimney system 50 in no way limits the scope of the present invention.

It should be noted that the present invention is not limited to the specific embodiments pictured and described herein, but is intended to apply to all similar apparatuses for handling fluid materials. Modifications and alterations from the described embodiments will occur to those skilled in the art without departure from the spirit and scope of the present invention.

The invention claimed is:

1. A method for making a chimney section, said method comprising:

a. cutting a piece of material to a rectangular shape having first and second short ends and first and second long ends;

b. forming a first crease in said material adjacent said first short end, wherein said first crease is substantially parallel to said first short end and extends from said first long end to said second long end, and wherein said first crease is spaced from said first short end by a first distance;

c. defining a first outer section on said piece of material between said first short end and said first crease;

d. forming a second crease in said material adjacent said first crease, wherein said second crease is substantially parallel to said first crease and extends from said first long end to said second long end, and wherein said second crease is spaced from said first crease by a second distance;

e. defining a first inner section on said piece of material between said first crease and said second crease;

f. forming a third crease in said material adjacent said second crease, wherein said third crease is substantially parallel to said first crease and extends from said first long end to said second long end, and wherein said third crease is spaced from said second crease by two times said first distance;

g. defining a middle section on said piece of material between said second crease and said third crease;

h. forming a fourth crease in said material adjacent said third crease, wherein said fourth crease is substantially parallel to said first crease and extends from said first long end to said second long end, and wherein said fourth crease is spaced from said third crease by said second distance;

i. defining a second inner section on said piece of material between said third crease and said fourth crease;

j. defining a second outer section on said piece of material between said fourth crease and said second short end, wherein the distance from said fourth crease to said second short end is equal to said first distance, and wherein said first outer section, said first inner section, said middle section, said second inner section, and said second outer section form a total of five sections in said piece of material;

k. forming said first outer section into generally a quarter circle shape, wherein said first crease is a boundary for and not positioned in said first outer section, and wherein said first crease is a smooth, curved transition between said first outer section and said first inner section;

l. forming said second outer section into generally a quarter circle shape, wherein said fourth crease is a boundary for and not positioned in said second outer section, and wherein said fourth crease is a smooth, curved transition between said second outer section and said second inner section;

m. forming said middle section into generally a half circle shape, wherein said second and third creases are boundaries for and not positioned in said middle section, wherein said second crease is a smooth, curved transition between said first inner section and said middle section, and wherein said third crease is a smooth, curved transition between said second inner section and said middle section; and, n. attaching said first short end to said second short end to connect said first outer section to said second outer section, thereby forming a half circle.

2. The method according to claim 1 wherein said attaching step is further defined as using welding.

3. The method according to claim 2 further comprising the step of forming a flange around the periphery of said first long end, wherein said flange is generally perpendicular with respect to the longitudinal axis of said chimney section.

4. The method according to claim 3 wherein said first and second distances are further defined as being equal.

5. A method for making a chimney section, said method comprising:

a. cutting a sheet of material to a rectangular shape having first and second short ends and first and second long ends, wherein said sheet has a planar top surface and a planar bottom surface separated from one another by a thickness of said sheet;

b. forming four creases in said sheet, wherein each said crease is parallel to said first and second short ends, and wherein each said crease extends from said first long end to said second long end;

c. identifying five sections created by said four creases and said first and second short ends;

d. defining a first outer section positioned between said first short end and a first crease of said four creases, wherein said first crease is spaced from said first short end by a first distance;

e. defining a first inner section between said first crease and a second crease of said four creases, wherein said second crease is spaced from said first crease by a second distance;

f. defining a middle section between said second crease and a third crease of said four creases, wherein said third crease is spaced from said second crease by an amount equal to two times said first distance;

g. defining a second inner section between said third crease and a fourth crease of said four creases, wherein said fourth crease is spaced from said second crease by said second distance;

h. defining a second outer section positioned between said fourth crease and said second short end, wherein said fourth crease is spaced from said second short end by said first distance;

i. forming a first outer section into a generally quarter circle shape along a length of said first and second long ends;

j. forming said second outer section into generally a quarter circle shape along a second length of said first and second long ends;

k. forming said middle section into generally a half circle shape along a third length of said first and second long ends; and, l. attaching said first outer section to said second outer section at said first short end and said second short end such that said quarter circle shape of said first outer section and said quarter circle shape of said second outer section form a generally half circle shape.

6. The method according to claim 5 wherein said attaching step is further defined as using welding.

7. The method according to claim 6 further comprising the step of forming a flange around the periphery of said first long end, wherein said flange is generally perpendicular with respect to the longitudinal axis of said chimney section.

8. The method according to claim 5 wherein said four creases are further defined as being symmetrical about a width and a height of said sheet.

9. The method according to claim 5 wherein said first distance is equal to said second distance.

10. The method according to claim 5 wherein said first distance is greater than said second distance.

11. The method according to claim 5 wherein said first distance is less than said second distance.

12. A method for making a chimney section, said method comprising:

a. cutting a piece of material to a rectangular shape having first and second short ends and first and second long ends;

b. forming a first crease in said material adjacent said first short end, wherein said first crease is substantially parallel to said first short end and extends from said first long end to said second long end, and wherein said first crease is spaced from said first short end by a first distance;

c. defining a first outer section on said piece of material between said first short end and said first crease;

d. forming a second crease in said material adjacent said first crease, wherein said second crease is substantially parallel to said first crease and extends from said first long end to said second long end, and wherein said second crease is spaced from said first crease by a second distance;

e. defining a first inner section on said piece of material between said first crease and said second crease;

f. forming a third crease in said material adjacent said second crease, wherein said third crease is substantially parallel to said first crease and extends from said first long end to said second long end, and wherein said third crease is spaced from said second crease by two times said first distance;

g. defining a middle section on said piece of material between said second crease and said third crease;

h. forming a fourth crease in said material adjacent said third crease, wherein said fourth crease is substantially parallel to said first crease and extends from said first long end to said second long end, and wherein said fourth crease is spaced from said third crease by said second distance;

i. defining a second inner section on said piece of material between said third crease and said fourth crease;

j. defining a second outer section on said piece of material between said fourth crease and said second short end, wherein the distance from said fourth crease to said second short end is equal to said first distance, and wherein said first outer section, said first inner section, said middle section, said second inner section, and said second outer section form a total of five sections in said piece of material;

k. forming said first outer section into generally a quarter circle shape;

l. forming said second outer section into generally a quarter circle shape;

m. forming said middle section into generally a half circle shape; and, n. attaching said first short end to said second short end to connect said first outer section to said second outer section, thereby forming a half circle.

13. The method according to claim 12 wherein said attaching step is further defined as using welding.

14. The method according to claim 13 further comprising the step of forming a flange around the periphery of said first long end, wherein said flange is generally perpendicular with respect to the longitudinal axis of said chimney section.

15. The method according to claim 14 wherein said first and second distances are further defined as being equal.

16. The method according to claim 12 wherein said four creases are further defined as being symmetrical about a width and a height of said sheet.

17. The method according to claim 12 wherein said first distance is equal to said second distance.

18. The method according to claim 12 wherein said first distance is greater than said second distance.

19. The method according to claim 12 wherein said first distance is less than said second distance.

* * * * *